US008350176B2

(12) United States Patent
Mohn et al.

(10) Patent No.: US 8,350,176 B2
(45) Date of Patent: Jan. 8, 2013

(54) METHOD OF FORMING, INSERTING AND PERMANENTLY BONDING RIBS IN BOILER TUBES

(75) Inventors: Walter R. Mohn, North Canton, OH (US); George B. Watson, Uniontown, OH (US); John Hainsworth, Canton, OH (US); James M. Tanzosh, Silver Lake, OH (US); Douglas D. Zeigler, Atwater, OH (US)

(73) Assignee: Babcock & Wilcox Power Generation Group, Inc., Barberton, OH (US)

( * ) Notice: Subject to any disclaimer, the term of this patent is extended or adjusted under 35 U.S.C. 154(b) by 1223 days.

(21) Appl. No.: 12/134,295

(22) Filed: Jun. 6, 2008

(65) Prior Publication Data

US 2009/0301159 A1 Dec. 10, 2009

(51) Int. Cl.
*B23K 1/008* (2006.01)

(52) U.S. Cl. . 219/62; 219/85.22; 219/85.1; 228/262.31; 228/262.42; 228/262.9; 148/519; 148/528

(58) Field of Classification Search ..... 219/62, 219/59.1, 60 R, 61, 603, 605; 228/182, 184, 228/245, 262.3, 262.31, 183; 148/23–24
See application file for complete search history.

(56) References Cited

U.S. PATENT DOCUMENTS

| | | | | | |
|---|---|---|---|---|---|
| 1,617,583 | A * | 2/1927 | Fentress | 72/49 |
| 2,708,306 | A * | 5/1955 | Lampton | 228/182 |
| 2,976,907 | A * | 3/1961 | Harvey et al. | 72/56 |
| 3,140,378 | A * | 7/1964 | Benninghoff | 219/610 |
| 3,246,116 | A * | 4/1966 | Anderson et al. | 219/61 |
| 3,289,451 | A * | 12/1966 | Koch et al. | 72/283 |
| 3,422,518 | A * | 1/1969 | French | 72/77 |
| 3,662,582 | A * | 5/1972 | French | 72/370.17 |
| 3,896,860 | A * | 7/1975 | Iannucci | 140/149 |
| 4,708,194 | A * | 11/1987 | Mohn | 164/463 |
| 6,156,134 | A * | 12/2000 | Shimizu et al. | 148/526 |
| 6,749,104 | B2 * | 6/2004 | Rabinkin | 228/183 |
| 6,852,428 | B2 * | 2/2005 | Hirota et al. | 428/680 |

* cited by examiner

*Primary Examiner* — Joseph M Pelham
*Assistant Examiner* — Gyounghyun Bae
(74) *Attorney, Agent, or Firm* — Michael J. Seymour; Eric Marich

(57) ABSTRACT

A method of providing boiler tubes with a variably ribbed interior surface. A suitably dimensioned spindle with a channel having a desired pattern on the exterior surface of the spindle is wrapped by a wire-like member in the channel so as to form thereon a reverse image of the desired, patterned tube ribbing. A brazing metal paste is applied on the exterior surface of the wire-like member and the spindle is inserted into a tube to be ribbed. The wire-like member is released from the spindle to allow the wire-like member to conform to the inner surface of the tube, and the tube is heated to the melting temperature of the brazing metal paste so that the wire-like member bonds to the inner surface of the tube, and the metal tube is then cooled.

14 Claims, 2 Drawing Sheets

METHOD OF FORMING, INSERTING AND PERMANENTLY BONDING RIBS IN BOILER TUBES

FIELD AND BACKGROUND OF THE INVENTION

This invention relates generally to tubing utilized in steam generating equipment and, more specifically, to a method of forming internally ribbed boiler tubes. The ribbing provides controlled internal flow disruption within the tubes to prevent stagnation of the steam bubbles that are formed during nucleate boiling; i.e., an operating condition wherein stagnating steam bubbles form an insulating layer which impedes the passage of the heat through the tube wall to the water flowing therein.

A major operating component of any conventional steam generating system is the boiler. The generation of steam is commonly accomplished by passage of water through a multiplicity of tubes, during which passage the water is sufficiently heated so as to cause it to change state; i.e., to change from a liquid to a vapor.

As the water flows through the tube, the water in closest proximity to the inner wall of the tube becomes heated by the heat being transmitted through the tube wall. This outer layer of water changes to steam. During this process of changing to steam, the first change which the outer layer of water undergoes is the formation therein of steam bubbles. The steam bubbles act as an insulating layer. Unless the steam bubbles are made to mix with the water in the tube, they will remain adjacent the tube wall, and take on the attributes of an insulating layer or film, thereby causing localized hot spots to develop along the tube wall. These hot spots, in turn, can cause overheating of the tube, and ultimately lead to tube failure. Additionally, unless they are made to mix, the steam bubbles by virtue of their insulating capability will also function to prevent further heating of the core of water, which is passing rapidly through the center the tube.

Thus, in order to achieve the rapid and efficient transfer of heat through the tube walls to the water flowing therein, a need exists to provide some form of means to break up the laminar flow of water through the tube and to effect the mixing of the outer layer of water and thereby also the steam bubbles entrained therein with the core of water flowing through the central region of the tube. One such means which has been employed in the prior art involves the usage of ribbing (lands or grooves) on the internal surfaces of the boiler tubes.

As regards the nature of the existing prior art relating to methods of making boiler tubes with ribbed inner wall surfaces, reference may be had to U.S. Pat. Nos. 3,088,494; 3,213,525; 3,272,961; 3,289,451 and 3,292,408. U.S. Pat. No. 3,088,494, which issued to P. H. Koch et al., is directed to providing a vapor generating tube that has its interior wall formed with helical lands and grooves, which are proportioned and arranged in a particular predetermined fashion. U.S. Pat. No. 3,213,525, which issued to W. M. Creighton et al., is directed to a method of forming an internal rib in the bore of a tube wherein material is removed from the inner tube wall by means of a cutting operation to form the subject ribbing. A still further example of these prior art teachings can be found in U.S. Pat. No. 3,272,961, which issued to L. A. Maier, Jr. et al., and wherein a method and apparatus are taught for making ribbed vapor generating tubes and in accordance with which a rib is deposited on the inside surface of the tube by means of a welding process. U.S. Pat. No. 3,289,451, which issued to P. H. Koch et al., is directed to a method and apparatus for forming internal helical ribbing in a tube wherein the internal ribbing is formed by means of a cold drawing operation. Finally, U.S. Pat. No. 3,292,408, which issued to J. R. Hill, is directed to a method of forming internally ribbed tubes wherein the tube is provided with an asymmetrical helical groove so as to facilitate removal of the forming tool from the tube.

Notwithstanding the existence of these prior art teachings, there is a need for a new and improved method of providing boiler tubes with a ribbed interior surface. The prior art methods that have been employed for this purpose have notable disadvantages and can be relatively expensive to employ.

One disadvantage in using these prior art methods and apparatus is the difficulty in successfully removing the forming member from the tube following completion of the metal deformation process. Generally, a member having a predetermined external configuration, such as a helical pattern, is inserted into the tube, and thereafter the tube is reduced in diameter such that the helical pattern on the member is formed in the inner wall of the tube. In order to remove this member from the tube it is necessary, because of the fact that the interior surface of the tube has been deformed so as to become essentially an exact complement of the member's external surface, to virtually unscrew the member from the tube to effect the removal of the former from the latter. The degree of difficulty in effecting the removal of the member from the tube depends on the length of the member which has been inserted into the tube, and the relative extent to which the pattern formed on the inner tube wall is a true complement of the pattern formed on the external surface of the aforesaid member.

Current methods of fabricating single lead rib (SLR) boiler tubes and multi-lead rib (MLR) boiler tubes often requires either mechanical or metallurgical deformation processing wherein a smooth tube is drawn over a slotted, rotating mandrel. During this process, the smooth interior surface of the tube is plastically deformed and forced to progressively conform to the slotted mandrel shape, thereby producing helical lead ribs along the tube length. This deformation process is not only difficult and costly but is also inherently limited in its ability to accurately produce rib cross-sectional shapes with the desired geometric detail and with the required dimensional accuracy. The conventional metallurgical processes are limited in their ability to produce optimized rib lead angles of 40° or more.

Further, the production of SLR and MLR tubes from high temperature, high strength, and deformation-resistant materials (such as alloy 800H), is very difficult using conventional deformation processing methods.

SUMMARY OF THE INVENTION

One aspect of the present invention is drawn to provide a new and improved method of making boiler tubes wherein the latter are provided with means operative to cause a controlled internal flow disruption to be effected therewithin.

Another aspect of the present invention is drawn to provide a method of making boiler tubes wherein the latter are provided with inner tube surfaces that are ribbed.

Another aspect of the present invention is drawn to a method of making ribbed boiler tubes wherein the ribbed pattern to be formed in the tube inner surface is established by detachably wrapping a wire-like member around the circumference of a spindle.

Yet another aspect of the present invention is drawn to a method of making a ribbed boiler tube wherein the spindle may be removed from the boiler tube leaving the wire-like member attached to the tube inner wall.

Yet still another aspect of the present invention is drawn to a method of making a ribbed boiler tube which is advantageously characterized by the fact that it is relatively inexpensive to utilize, relatively simple to employ, and is extremely flexible insofar as concerns the variety of different patterns of ribbing; i.e., helical, circular, etc. that can be formed therewith in boiler tubes.

Accordingly, the method of the present invention involves fabrication of tubes having a smooth interior surface and a separate fabrication of the wire-like rib members, which are typically formed from a flat, non-circular metal wire. The wire-like rib members are typically trapezoidal in cross-section, but could also be rectangular, square or some other desired geometric shape including circular. The ribs are subsequently inserted and positioned within the smooth tube and braze-bonded to the interior tube surface to permanently affix the position and orientation of the ribs by using a corrosion resistant, nickel-based filler metal.

The SLR and MLR tubes and the wire-like rib members can be produced from a variety of different metal materials, including carbon steel, stainless steel and nickel-base alloys.

The various features of novelty which characterize the invention are pointed out with particularity in the claims annexed to and forming a part of this disclosure. For a better understanding of the invention, its operating advantages and specific benefits attained by its uses, reference is made to the accompanying drawings and descriptive matter in which preferred embodiments of the invention are illustrated.

DESCRIPTION OF THE PREFERRED EMBODIMENTS

Figure 5:
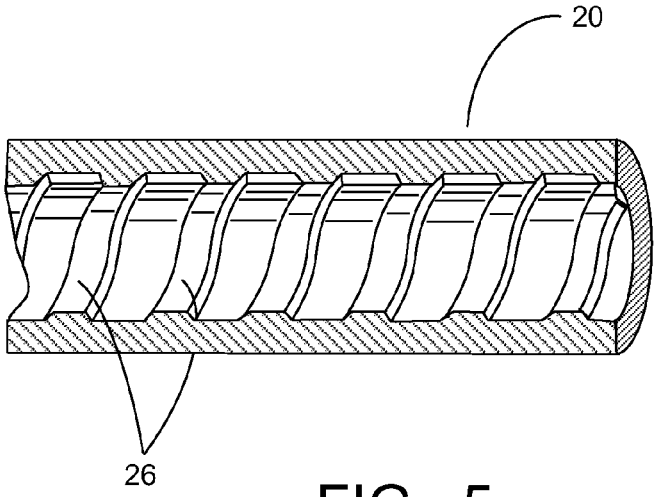
FIG. 5 is a side sectional view of the helical ribbing in a portion of a boiler tube that has been provided in accordance with the method of the present invention.

Referring to the drawings generally, wherein like reference numerals designate the same or functionally similar elements throughout the several drawings, and more particularly to FIG. 5 thereof, there is depicted therein a boiler tube, generally designated by reference numeral 20 which, through the practice of the method of the present invention, has been provided with means operable for effecting a controlled internal flow disruption of the fluid that is passed through the boiler tube 20. More specifically, the boiler tube 20 is provided with a ribbing 26 which is helical that functions to produce turbulence within the tube 20 which, in turn, is operative to effect a breaking up of the laminar flow of water or steam that would flow through the tube 20. This promotes more efficient heat transfer during steam generation to prevent overheating of the tube 20, particularly that stemming from the stagnation of the steam bubbles formed during nucleate boiling.

Figure 1:
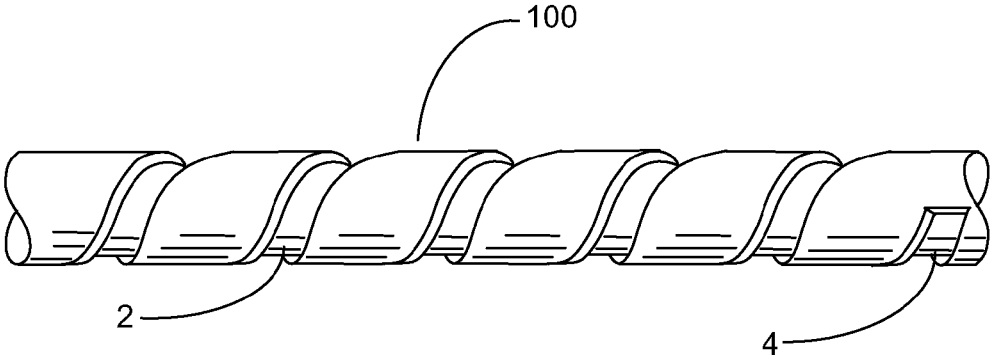
FIG. 1 is a side view of a spindle embodiment equipped with an optional helical channel.

In accordance with the invention, a method is provided wherein a spindle 100, a portion of which has been depicted in FIG. 1 of the drawings, is utilized in the making of the helically ribbed boiler tube 20. The spindle 100 is preferably provided with a helically-shaped channel 2 formed on the exterior surface of the spindle 100 and having a width and depth sufficient to accommodate a wire-like rib material (not shown) that will be used to form the ribs on the inner surface of the tube. The channels 2 are helically oriented with a pitch angle and configuration corresponding to the desired SLR or MLR rib pitch angle.

The spindle 100 is suitably dimensioned so as to be received within the boiler tube 20. More specifically, the spindle 100 may take the form of any suitable conventional type of metallic, ceramic, natural, or polymeric member that is substantially cylindrical in configuration, and which is capable of being utilized in the manner of a spindle. Alternatively, spindles without channels 2 may be used.

Figure 2:
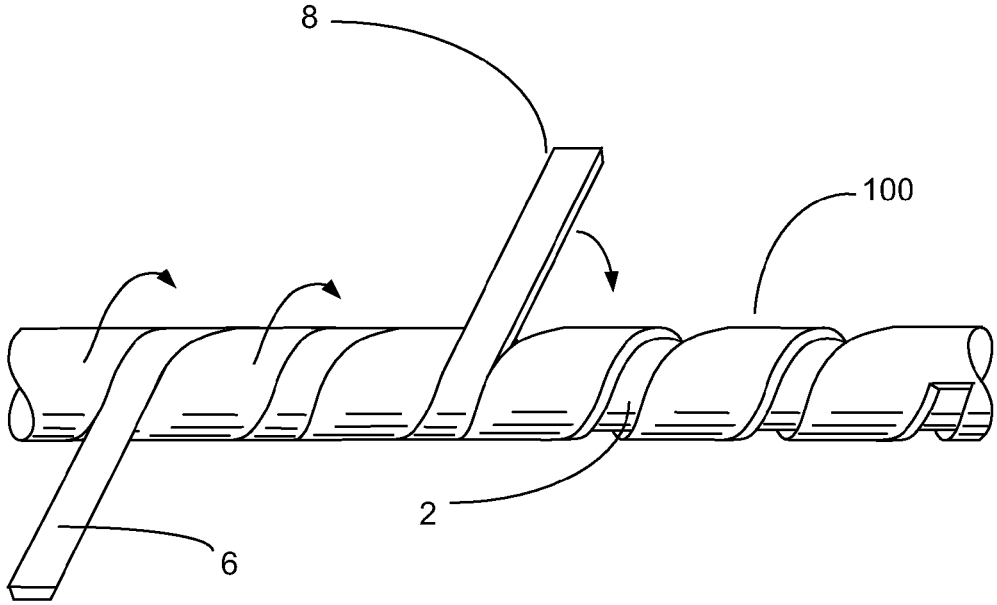
FIG. 2 is a side elevational view of the step of wrapping a wire-like member into the helical channel of the spindle.

As shown in FIG. 2, an elastically-resilient, wire-like member 6 is wound into the channels 2 of the spindle 100. The wire-like member 6 may take the form of a helical wire or a spiral flat strip as shown in FIG. 2, or any other type of wire-like member that is the functional equivalent of the helical wire and the spiral flat strip. The wire-like member can have a square, rectangular, trapezoidal, or other desired cross-section and be formed of metal, including, but not limited to, carbon steel, low alloy steel, stainless steel and nickel-base alloys.

The ends 8 of the wire-like member 6 are then temporarily affixed to the ends 4 of the spindle 100 for the purpose of holding the wound, elastically-compressed member 6 within the helical channel 2, or smooth surface is a channel is not used, of the spindle 100.

Figure 3:
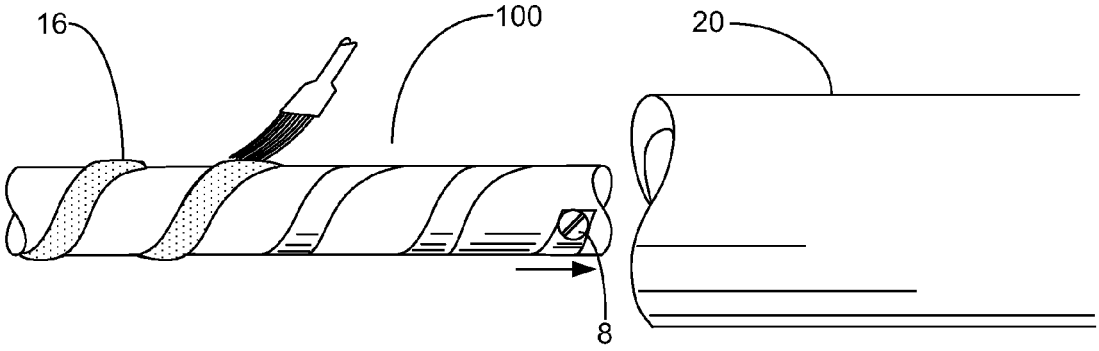
FIG. 3 is a side elevational view of applying filler metal material to the exterior surface of the wire-like member and inserting the spindle into a boiler tube.

With the wire-like member 6 having been wound in the channel 2 of the spindle 100, the next step in accordance with the method of the present invention, as shown in FIG. 3, is to apply a brazing filler metal paste 16 on the exterior surface of the wire-like member 6. The brazing filler metal paste 16 is preferably BNi-2 nickel-bearing brazing filler metal paste; however any brazing filler metal paste or foil can be used. The brazing filler metal paste 16 is generally applied by brushing it onto the wire-like member 6 or by using some other known method for applying such material onto surfaces. Alternatively, the brazing filler metal paste or foil can be applied to the inner diameter 22 of the boiler tube 20, or to both the wire like member 6 and inner diameter 22 of boiler tube 20.

Figure 4:
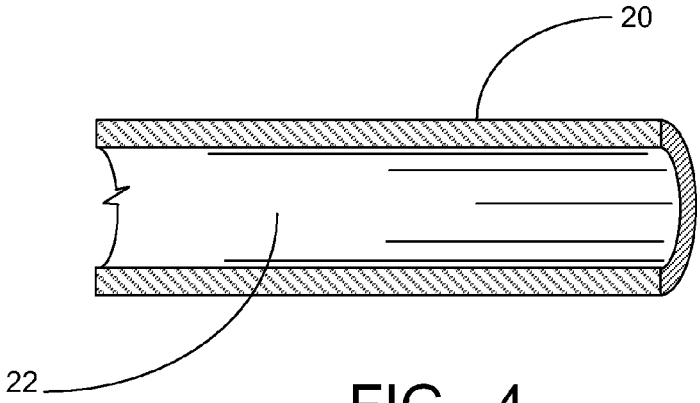
FIG. 4 is a side sectional view of smooth inner surface of a portion of a boiler tube.

Referring to FIG. 3, the next step of the method of the present invention is to insert the spindle 100 with the wire-like member 6 wrapped thereon into a boiler tube 20 (shown in FIG. 4). The ends 8 of the wire-like member 6 are released, allowing the elastically resilient helical windings to expand, conform to and contact the smooth inner surface 22 of the tube 20, thereby positioning helical ribs in preparation for bonding. The brazing filler metal paste 16 serves as a lubricant to facilitate unwinding of the wire-like member 6 and the conformal seating of the wire-like member 6 against the internal tube surface 22.

Once the wire-like member 6 is conformed to the inner tube wall 22, the next step that is performed in accordance with the present invention is the removal of the spindle 100 from the interior of the boiler tube 20.

After the spindle 100 is removed, the wire-like member 6 is brazed to permanently affix its position and orientation within the tube 20. Brazing of the wire-like member 6 to the inner surface 22 of the tube 20 could be done by heating the tube 20 to the melting temperature of the brazing filler metal 16 in a gas-fired or electric continuous mesh-belt conveyor furnace, a gas-fired or electric roller hearth conveyor furnace, a gas-fired or electric box furnace, induction heating, or any other means of applying heat to the assembly.

Several brazing filler metals are available which could be used to bond the wire-like member to the tube interior surface. However, it should be recognized that the different alloying elements in brazing filler metal BNi-2 (where Ni=82.6%, Cr=7%, Fe=3%, Si=4.5%, B=2.9%) together will depress the melting point of the alloy to 1830° F. (where, for comparison, pure nickel melts at 2551° F.). If the time at brazing temperature with this filler metal is extended to about 1 hour, most of the boron will diffuse out of the braze joint and into the base metal of the tube and wire ribs. This will result in an integral, finished braze joint of Ni—Cr—Si—Fe with high strength, enhanced corrosion resistance and, due to the boron diffusion, a higher melting point (typically about 2300° F.) than the original brazing filler metal. Accordingly, BNi-2 is particularly amenable to bonding the wire ribs to the interior surface of tubes which are intended for operation at elevated temperatures.

After cooling of the tube 20, there is provided in accordance with the method of the present invention a boiler tube 20 that has a helical ribbed pattern formed on the inner wall 22 thereof. Reference may be had to FIG. 5 of the drawing for an illustration of such a boiler tube 20 embodying a helical ribbed pattern 26. It should be noted that the method of the present invention is not limited to a helical ribbed pattern, but can form different ribbed patterns on the inner surface of a boiler tube.

The cost of making SLR and MLR boiler tubes using the new method described above is competitive with the cost of making conventional SLR and MLR boiler tubing using metal deformation processing techniques. Use of this fabrication method provides greater flexibility in SLR and MLR design since parameters such as rib cross-sectional shapes and rib lead angles are not restricted by limitations in producing integral ribs through metal deformation processing. This greater flexibility enables development of a unique design for SLR and MLR boiler tubes, such as complex cross sections not achievable by the prior art deformation means, that improve performance at decreased production costs. Also, the production of SLR and MLR tubes from high temperature, high strength, deformation-resistant materials (such as alloy 800H) is very difficult using conventional deformation processing methods.

While a specific embodiment of the invention has been shown and described in detail to illustrate the application of the principles of the invention, it will be understood that the invention may be embodied otherwise without departing from such principles.

We claim:

1. A method for forming a ribbing in an inner wall of a tubular member comprising the steps of:

providing a spindle having a lesser diameter than the internal diameter of the tubular member;

compressively wrapping a wire-like member helically along the length of the spindle;

applying a metal brazing material onto an exterior surface of the wire-like member;

inserting the spindle with the wire-like member wrapped thereon into the interior of the tubular member;

releasing the compression on the compressively wrapped wire-like member;

withdrawing the spindle from the tubular member thereby leaving the wire-like member in the tubular member such that the wire-like member remains in the tubular member;

heating the tubular member thereby melting the metal material to bond the wire-like member to an inner surface of the tubular member;

wherein the metal material is BNi-2 nickel-bearing brazing filler paste;

wherein the wire-like member has a quadrilateral cross section.

2. The method as claimed in claim 1 wherein the spindle comprises a helical shaped channel.

3. The method as claimed in claim 1 further including the step of attaching an end of the wire-like member to the spindle to prevent the end of the wire-like member from becoming dislodged from the spindle.

4. The method as claimed in claim 1 wherein the wire-like member has a circular cross section.

5. The method as claimed in claim 1 wherein the wire-like member has a trapezoidal cross section.

6. The method as claimed in claim 1 wherein the wire-like member has a trapezoidal cross section.

7. A method for forming a helical ribbing in the inner wall of a tubular member comprising the steps of:

providing a spindle having a lesser diameter than the internal diameter of the tubular member, the spindle having a helical channel extending a length of the spindle;

wrapping a wire-like member in the helical channel of the spindle;

attaching an end of the wire-like member to the spindle to prevent the end of the wire-like member from becoming dislodged from the spindle;

applying BNi-2 nickel-bearing brazing paste onto an exterior surface of the wire-like member;

inserting the spindle with the wire-like member wrapped thereon into the interior of the tubular member;

releasing the compression on the compressively wrapped wire-like member;

withdrawing the spindle from the tubular member thereby leaving the wire-like member in the tubular member such that the wire-like member expands to conform to an inner surface of the tubular member; and heating the tubular member at a temperature which is at least the melting point of the BNi-2 nickel-bearing brazing filler thereby melting the BNi-2 nickel-bearing brazing filler to bond the wire-like member to an inner surface of the tubular member.

8. A method for forming a ribbing in an inner wall of a tubular member comprising the steps of:

providing a spindle having a lesser diameter than the internal diameter of the tubular member;

compressively wrapping a wire-like member helically along the length of the spindle;

applying a metal brazing material to the interior surface of the tubular member;

inserting the spindle with the wire-like member wrapped thereon into the interior of the tubular member;

releasing the compression on the compressively wrapped wire-like member;

withdrawing the spindle from the tubular member thereby leaving the wire-like member in the tubular member such that the wire-like member remains in the tubular member; and heating the tubular member thereby melting the metal material to bond the wire-like member to an inner surface of the tubular member.

9. The method as claimed in claim 8 wherein the spindle comprises a helical shaped channel.

10. The method as claimed in claim 8 wherein the metal material is BNi-2 nickel-bearing brazing filler paste.

11. The method as claimed in claim 8 further including the step of attaching an end of the wire-like member to the spindle to prevent the end of the wire-like member from becoming dislodged from the spindle.

12. The method as claimed in claim 8 wherein the wire-like member has a circular cross section.

13. The method as claimed in claim 8 wherein the wire-like member has a rectangular cross section.

14. The method as claimed in claim 8 wherein the wire-like member has a trapezoidal cross section.

* * * * *